United States Patent [19]

Fuehrer

[11] Patent Number: 5,056,837

[45] Date of Patent: Oct. 15, 1991

[54] TAMPER RESISTANT SHACKLE SEAL WITH ASSEMBLED LOCKING COMPONENTS

[75] Inventor: Charles Fuehrer, Scarsdale, N.Y.

[73] Assignee: Stoffel Seals Corporation, Nyack, N.Y.

[21] Appl. No.: 556,399

[22] Filed: Jul. 24, 1990

[51] Int. Cl.[5] ..... B65D 33/34

[52] U.S. Cl. ..... 292/307 R; 292/318; 292/320

[58] Field of Search ..... 74/16 PB; 292/307 R, 292/318, 319, 320, 321, 322

[56] References Cited

U.S. PATENT DOCUMENTS

| | | | |
|---|---|---|---|
| 3,466,077 | 9/1969 | Moberg . | |
| 3,712,655 | 1/1973 | Fuehrer . | |
| 3,881,759 | 5/1975 | Fuehrer | 292/321 |
| 3,954,295 | 5/1976 | Harley . | |
| 4,059,300 | 11/1977 | Moberg et al. . | |
| 4,229,031 | 10/1980 | Guiler . | |
| 4,319,776 | 3/1982 | Moberg . | |
| 4,559,676 | 12/1985 | Paradis . | |
| 4,588,218 | 5/1986 | Guiler et al. | 292/307 R |
| 4,609,218 | 9/1986 | Chevillard et al. . | |
| 4,946,210 | 8/1990 | Fuehrer . | |
| 4,950,007 | 8/1990 | Swift | 292/370 |

FOREIGN PATENT DOCUMENTS

| | | | |
|---|---|---|---|
| 2714918 | 10/1978 | Fed. Rep. of Germany | 292/322 |
| 1430093 | 3/1976 | United Kingdom | 292/321 |
| 2163707 | 3/1986 | United Kingdom | 292/318 |
| 2164003 | 3/1986 | United Kingdom | 292/318 |
| 2184067 | 6/1987 | United Kingdom | 292/320 |
| 2205279 | 12/1988 | United Kingdom | 292/320 |

*Primary Examiner*—Eric K. Nicholson

*Attorney, Agent, or Firm*—Dowell & Dowell

[57] ABSTRACT

A shackle seal which includes a housing that is open at each end and which receives through one end an enlarged end portion of an integrally formed shackle or strap which is engaged by an assembly of locking teeth which is formed of a material having a higher melting point than the housing and which is slidingly received within the housing and retained therein by a plug which closes the other end of the housing.

16 Claims, 2 Drawing Sheets

TAMPER RESISTANT SHACKLE SEAL WITH ASSEMBLED LOCKING COMPONENTS

BACKGROUND OF THE INVENTION

1. Cross Reference to Related Applications

This application is related to U.S. application Ser. No. 07/209,056 filed June 20, 1988, and entitled TAMPER RESISTANT SHACKLE SEAL which application is in the name of the present inventor.

2. Field of the Invention

This invention relates to seals of the type which are utilized for security and which include a housing connected to a strap member having an end which is receiving within the housing and locked therein. Such seals are utilized to prevent unauthorized openings or tampering of the seals which unauthorized tampering would not be readily detectable. More specifically, the present is directed to such a seal which is formed utilizing an assembly of locking teeth which are slidingly received within the housing and which are formed of a material having a higher melting point than the housing and the strap.

3. Description of the Related Art

Shackle seals have become well developed over the years. They are used for security sealing the doors associated with cargo containers and cargo trucks and the like. Among the requirements for such seals is that they are easy to use, that they function to reflect whether or not there has been unauthorized tampering of the seals during shipment of the cargo and that they are inexpensive. In view of the foregoing, one piece plastic seals have become the shackle seals of choice in most instances. Such seals are easy to stock, non-corrodible, easy to place in service, and easy for the authorized person to break and dispose of at the appropriate time.

Since truck and container cargos are valuable and subject to pilferage, the seals utilized therewith must be strong enough to withstand ordinary handling and therefore must not be subject to inadvertent breakage. Of special importance is that the structure of the seals be such that they may not be tampered with, opened and reclosed, without evidence of such opening being apparent.

The use of shackle seals which incorporate plastic housings having internal spring-like fingers which are provided to engage the end portion of a shackle or strap which is integrally formed with the housing is well known. In order for such housings to be secure against tampering, it is necessary that both ends of the housing be closed to prevent the insertion of pointed instruments which may be utilized to manipulate the spring-like fingers thereby allowing the withdrawal of the end portion of the strap or shackle and allowing access to a container by effectively defeating the locking engagement of the seal. Due to the internal structure of such seal housings, it is not economically feasible to manufacture such housings with one of the ends being molded closed.

In an effort to overcome the disadvantages of most prior art structures, in applicant's co-pending U.S. application Ser. No. 07/209,056 filed June 20, 1988, a special plug is disclosed for effectively sealing or closing one end of the housing after the pointed end of the strap has been inserted through the opposing end of the housing. More specifically, the seal includes a housing having opposite ends and which includes a plurality of spring-like fingers which are integrally molded within the housing and which are utilized to engage a reduced neck portion adjacent the pointed enlarged head portion of the integral shackle or strap of the seal. Thereafter, the opposing end of the housing is closed utilizing the separate plug. The plug includes an annular recess therein which is frictionally engaged by an annular rib formed internally of the housing. The spacing of the rib is such that the end portion of the plug is flush with the end of the housing. Due to the relationship between the rib and the recess of the plug, it becomes impossible to insert an instrument between the plug and the housing in order to obtain access to the locking fingers within the housing without providing an obvious visual indication of seal tampering.

Unfortunately, it has been noted that in rare instances it may be possible to apply heat to the seal, especially when the seal is formed of material such as polyethylene or polypropylene. The heat generated by a conventional electric hair dryer may be sufficient to soften the housing thereby making the components susceptible to opening and permitting surreptitious entry or unlocking of the seal. A further problem inherent in the manufacture of prior art seals, such as disclosed in applicant's co-pending application referenced above, is the cost of molding which is increased by the rate of production which must be slowed in order to permit the mass of plastic that must be molded to provide the spring elements inside the housing to be pushed through the mold and cooled.

Other prior art attempts to provide a closure for the open end of housings in shackle type seals are disclosed in U.S. Pat. Nos. to Moberg et al., 4,059,300 and Moberg, 3,466,077. In these patents, the closure for the open end of the housing is provided by an added step of molding over an end portion following the initial molding of the housing.

In U.S. Pat. No. 3,954,295 to Harley a plug element is disclosed for closing one end of the housing which plug is retained on a tab integrally formed with the housing. In U.S. Pat. No. 4,229,031 a plug is provided for closing one end of the housing which incorporates a pair of legs which compress inwardly when the plug is inserted into the housing. In U.S. Pat. No. 4,319,776 to Moberg a similar plug arrangement is disclosed.

Another example of a cap member for a plug is disclosed in U.S. Pat. No. 4,609,218 to Chevillard et al. In applicant's prior U.S. Pat. No. 3,712,655 a shackle seal is disclosed which incorporates indentations in a strap to provide an appropriate ease of shackle breakage to indicate tampering of a shackle seal. The above referenced patent to Harley also discloses the use of an opening in a strap member for facilitating breakage of the strap in order to indicate tampering with the seal.

U.S. Pat. No. 4,559,676 discloses a shackle seal having a tip member which has a portion that is compressed when it is inserted within the housing.

None of the aforementioned prior art shackle seals disclose the need for forming the locking components of a shackle type seal of a material having a higher melting point than the housing and strap or shackle of the seal in order to thwart unauthorized tampering of such seals.

SUMMARY OF THE INVENTION

This invention is directed to a shackle type seal of the type having a housing that is open at the opposite ends thereof and which includes an integrally formed strap or shackle having an enlarged end portion which is selectively received through one end of the housing. In order to retain the enlarged end of the strap within the housing a separately molded assembly of locking teeth is provided which assembly is selectively received within the housing and which is formed of a material having a higher melting point than the housing and strap. The assembly of locking teeth includes a plurality of independent teeth which are molded to a base ring and which are tapered inwardly so as to provide a resiliency or a spring-like effect for the individual teeth. The assembly also includes at least one pair of elongated spacer legs which are contoured at their uppermost ends so as to engage the innermost end of a separate plug which is inserted into the opposite end of the housing in order to seal the opposite end of the housing. The elongated legs will space the plug from the assembly of locking teeth to thereby prevent any interference of the plug with the spring-like teeth of the assembly. In order to further stabilize the assembly of locking teeth within the housing, a pair of shorter legs may be provided and spaced generally 90° from the elongated legs. The elongated legs and the two shorter legs will thereby engage the side walls of the housing ensuring a proper seating of the assembly of locking teeth within the housing.

It is the primary object of the present invention to provide a tamper resistant shackle seal in which the locking elements of the seal may be separately molded to thereby increase production rate and reduce cost of the seals and yet will provide a seal which will be effectively tamper resistant in use and will adequately indicate any attempt to tamper with or breach the seal during its use.

It is also an object of the present invention to provide a shackle seal wherein the locking components maintained within the housing of the seal are formed of a material having a higher melting point than the remaining portions of the seal so that tampering of the seal, through the application of heat, will be effectively prevented.

A BRIEF DESCRIPTION OF THE DRAWINGS

DESCRIPTION OF THE PREFERRED EMBODIMENT

Figure 1:
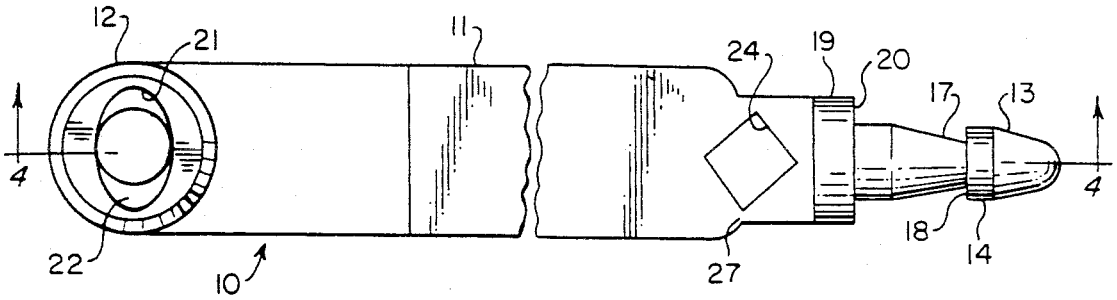
FIG. 1 is a top plan view of the shackle seal of the present invention.
Figure 4:
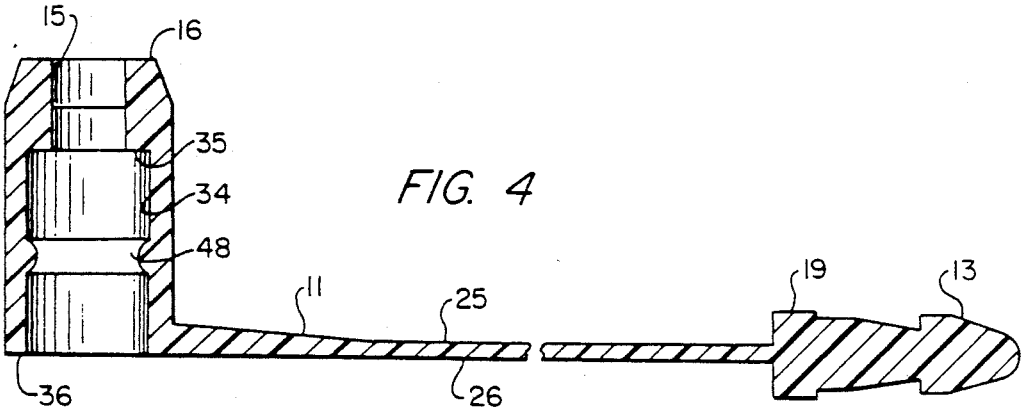
FIG. 4 is a cross sectional view taken along lines 4—4 of FIG. 1.
Figure 5:
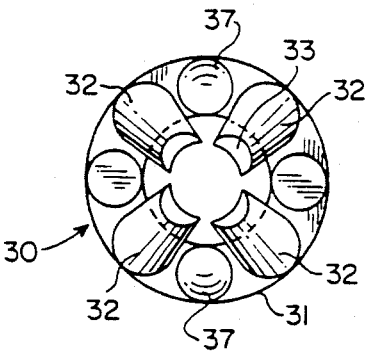
FIG. 5 is a top plan view of the locking teeth assembly of the present invention.
Figure 7:
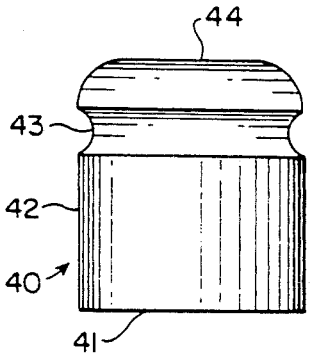
FIG. 7 is a side elevational view of the plug used to seal the housing of the present invention.

With continued reference to the drawings, the shackle seal 10 of the present invention is shown as including a strap 11 which is integrally formed at one end with a housing 12. The outer end of the strap includes an enlarged tip end portion 13 which tapers outwardly from the outermost end and which is of a diameter that the base portion 14 thereof to be closely received through an opening 15 through a first end 16 of the housing 12. Spaced inwardly of the base 14 of the end portion 13 is a reduced neck 17 which thereby defines a ledge 18 between the base 14 and the neck 17.

Spaced inwardly of the neck 17 of the strap 11 is a noncircular shoulder 19 defining an outer extending ledge 20 which is of a configuration to be engaged and completely fill a socket portion 21 formed in the first end portion of the housing and which defines a bearing seat 22 against which the ledge 20 of the shoulder 19 is engaged when the enlarged end portion 13 of the strap is inserted within the first opening of the housing.

The strap 11, preferably adjacent to the shoulder 19, has a non-circular opening 24 therein which, in the preferred embodiment, is diamond-shaped and provides a zone of weakness in the strap. The opening is preferably tapered from the top 25 of the strap to the bottom 26 of the strap and the width between the opening and the outer portions of the strap, as indicated at 27, will determine the strength of the strap at the area of the opening. The width 27 may be changed by merely rotating the diamond-shaped opening so that the width may be variably selected in order to permit selection of the breaking strength of the shackle strap. Such breaking strength may be selected for purposes of permitting an unauthorized person to break the strap to give a visual indication of tampering with the strap in the event that excessive force is used in an attempt to surreptitiously remove or open the seal. The seal housing 12 and the strap 11 are preferably formed of a synthetic, resinous material having some resiliency and particularly polyethylene or polypropylene.

Figure 6:
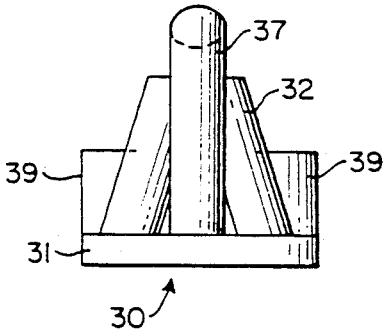
FIG. 6 is a side elevational view of the locking teeth assembly of the present invention.
Figure 2:
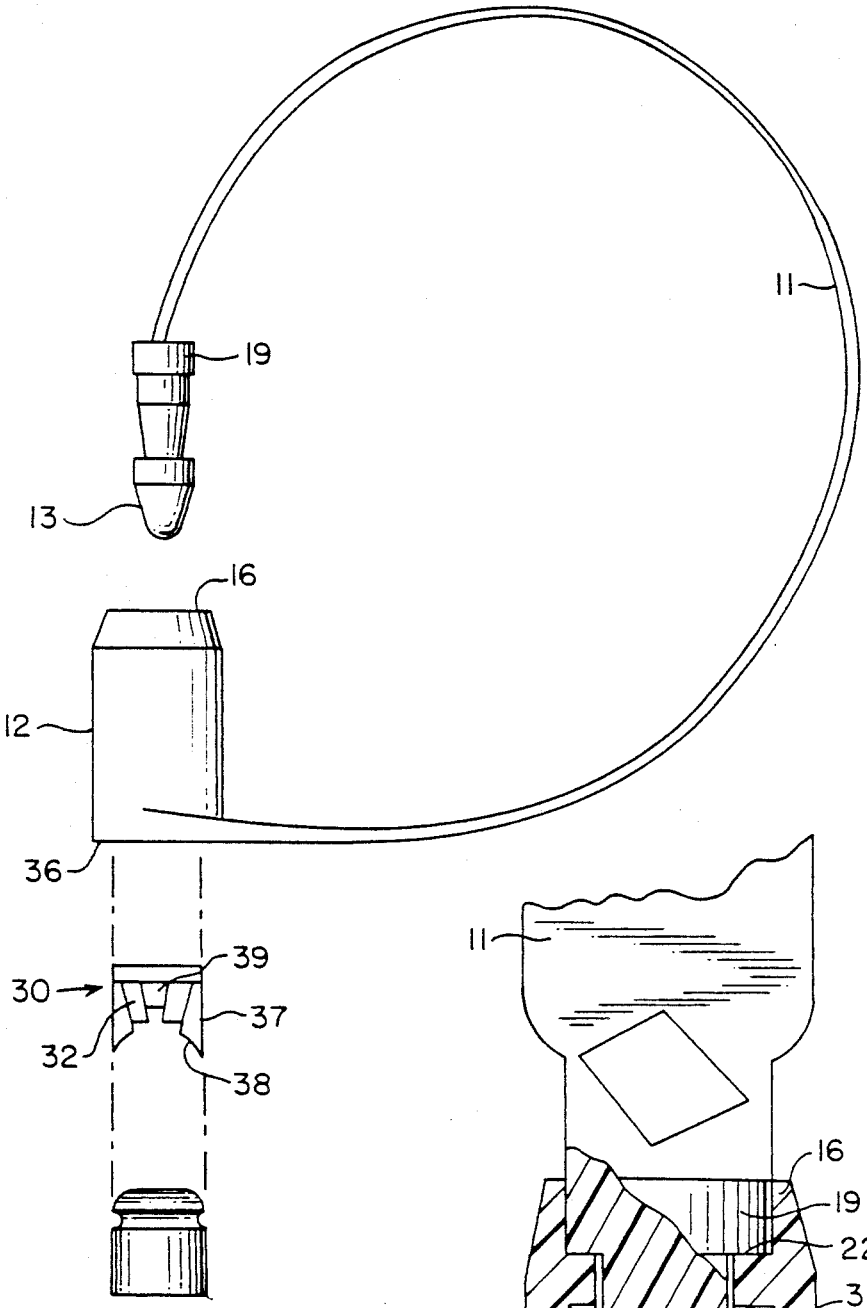
FIG. 2 is an assembly view showing the various components of the present invention shown in side elevation.

In order to securely engage the enlarged end portion 13 of the strap 11 within the housing, a separate locking assembly 30 is provided which is molded o formed of a material having a higher melting point than the resinous material from which the housing and strap are molded. Suitable types of materials for forming the plug are long chain synthetic polymeric amides which are known generically as nylon. The locking assembly includes an annular base 31 from which extend integrally formed spring-like fingers 32. The spring-like fingers extend upwardly from the ring 31 and inwardly as is shown in FIG. 6.

Figure 3:
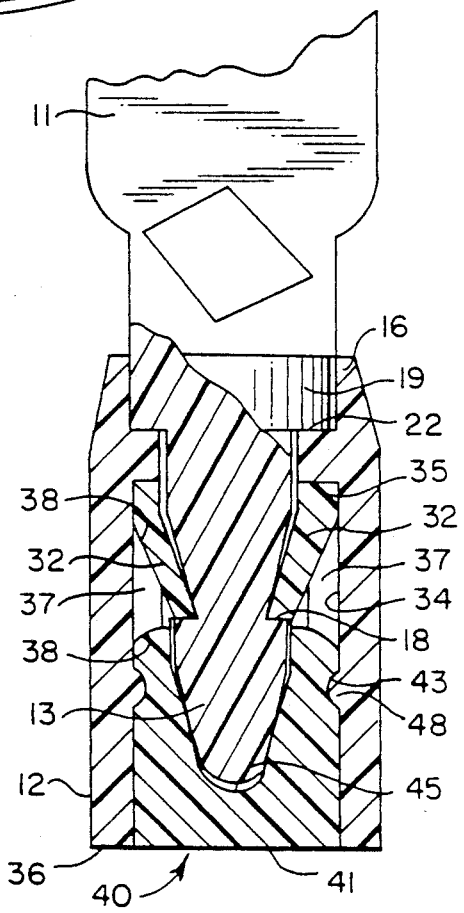
FIG. 3 is an enlarged cross-sectional view taken through the housing and showing the separate locking teeth assembly of the present invention as they engage the enlarged end of the strap or shackle of the seal and which further indicates the engagement of the elongated spacing legs of the locking assembly with respect to the inner portion of the plug which closes the opposite end of the housing.

The uppermost ends 33 of each of the spring-like finger are designed to engage with the ledge 18 at the base 14 of the end portion 13 of strap 11 to thereby prevent the withdrawal of the enlarged end portion from the housing 12 after the locking assembly has been inserted within the housing and the enlarged end portion of the strap inserted within the first end of the housing, as shown in FIG. 3. The dimension of the ring 31 is compatible with the inner diameter of the housing so that the ring engages the inner side walls 34 of the housing. When placed within the housing, the locking assembly 30 will be seated against an annular flange 35 facing inwardly of the housing and formed adjacent the first end 16 thereof. The spring-like fingers 32 will extend outwardly from the flange 35 toward the second or opposite end portion 36 of the housing.

The locking assembly 30 also includes a pair of elongated legs 37 which extend beyond the fingers 32. The upper ends 38 of each leg are tapered for purposes of which will be described in greater detail hereinafter.

The locking assembly further includes a pair of short leg members 39 which function together with the elongated legs 38 to engage the inner wall 34 of the housing 12 to stabilize the locking assembly and orient the assembly as it is inserted within the housing. In some instances, instead of utilizing two shorter legs, the two shorter legs may be formed as elongated legs similar to those shown at 37. It is noted that both the legs 37 and 39 extend generally parallel with the side walls of the housing as is shown best in FIG. 3.

In order to seal the second or remote end 36 of the housing, a separate plug 40 is provided. The plug 40 may likewise be formed of a material having a higher melting point than the melting point of the material from which housing and strap are formed. The plug includes an end wall 41, an annular skirt 42 in which is provided an annular groove 43 which is spaced inwardly from the tip 44 of the skirt. The skirt defines a hollow cavity 45 which is of a configuration so as to selectively receive the tapered end portion 13 of the shackle strap. The tip 44 of the plug is tapered or rounded so as to assist in the insertion of the plug relative to the housing. The side walls or skirt of the plug intermediate the annular groove 43 and the end 41 thereof is of a dimension which is slightly greater in diameter than the inner wall 34 of the housing in order that a substantial force is required to seat or force the plug within the housing thereby creating a stronger union or bond between the two. In order to retain the plug in position and prevent any unauthorized tampering by the insertion of a tool between the plug and the housing, an annular rib 48 is provided within the housing and which is spaced so as to engage within the annular groove 43 of the plug when the end wall 41 of the plug is flush with the end 36 of the housing. It is important that no portion of the plug extend outwardly of the housing so that the plug cannot be grasped or pried loose by a tool.

During the manufacturing of the seal and after the separate components have been molded, the locking assembly 30 is inserted from the second end of the housing into a seated engagement with the flange 35 inside the housing. Thereafter, the plug 40 is inserted within the second end and forced into the housing so that the annular groove 43 of the plug is seated on the annular flange 48 of the housing. The upper tapered ends 38 of the elongated legs 37 of the locking assembly will engage the skirt portion 44 of the plug and thereby limit the inner positioning of the plug relative to the housing. This is necessary in order to ensure that the skirt portion 44 of the plug will not interfere with or engage the spring-like fingers 32 of the locking assembly.

In use , when its desired to seal a door or other closure, the enlarged tip portion 13 of the strap 11 is wrapped around the handle and inserted within the first end 16 of the housing through the opening 15. When completely urged within the housing, the upper ends 33 of the spring fingers 32 will engage the ledge 18 adjacent the end portion 13 and secure the end 13 within the housing. When properly seated, the shoulder 19 of the strap 11 will be in engagement with the seat 22 formed within the opening 21.

As the plug fits snugly within the second end of the housing it is not possible to slide a tool past the plug and beyond the annular rib 48 formed within the housing. Likewise, it is not possible to insert a tool through the opposite end due to the seat 22 formed adjacent the opening in the opposite end. Any attempt to soften the housing utilizing heat will not have an effect upon the plug or the locking assembly thus prohibiting the removal of a heated assembly by manipulation of the end portion 13 of the locking strap from the housing 12. Any use of excessive force in order to pull the end portion 13 from the housing 12 will result in the breakage of the strap at the area of reduced weakness adjacent the opening 24 therein thereby providing an immediate visual indication of unauthorized tampering of the seal.

I claim:

1. In a shackle seal of the type including a housing having first and second ends and in which the housing is defined having an inner surface, and wherein the housing is integrally formed with an elongated strap having an outer end portion which is selectively receivable within the first end of said housing and wherein the housing and strap are formed of a first material, the improvement comprising, a separate locking assembly means insertable within the housing through the second end thereof, said locking assembly means being formed of a material having a higher melting point than the first material, said locking assembly means including a base and at least two yieldable locking finger means extending from said base and extending outwardly and inwardly with respect thereto toward the second end of the housing, plug means for selectively sealing the second end of the housing, and said locking assembly further including at least two elongated spacing leg means extending from said base, said leg means extending beyond said locking finger means and toward said plug means so as to space said plug means from said locking finger means.

2. The shackle seal of claim 1 in which said plug means includes an inner portion, said inner portion of said plug means being engagable with said leg means of said locking assembly when said plug means is received within said housing.

3. The shackle seal of claim 2 in which said elongated leg means include outermost ends which are tapered and said inner portion of said plug means is tapered so that said leg means and said inner portion of said plug means cooperatively abut one another when said plug means is inserted within said housing.

4. The shackle seal of claim 1 in which the inner surface of the housing includes an annular ridge formed in spaced relationship with respect to the second end thereof, said plug means including an annular groove therein spaced inwardly with respect to said outer portion thereof, said plug having an outer surface said annular ridge of said housing being seated within said annular groove of said plug means when said plug means is inserted within said second end of the housing.

5. The shackle seal of claim 4 in which said locking assembly includes at least two supplemental leg means, said supplemental leg means extending generally parallel with the inner surface of the housing, and being offset with respect to said elongated leg means whereby said elongated leg means and said supplemental leg means engage the inner surface of the housing when said locking assembly is inserted within said housing.

6. The shackle seal of claim 5 in which said base of said locking assembly is compatible with the inner surface of the housing.

7. The shackle seal of claim 4 in which said plug means is formed of a material having a higher melting point than said first material.

8. The shackle seal of claim 7 in which said inner portion of said plug means is yieldable.

9. The shackle seal of claim 8 in which said plug means has an outer dimension which is slightly greater than the configuration of the inner surface of the housing.

10. The shackle seal of claim 9 in which said first end of said housing includes a cavity formed therein, said outer portion of said strap including an enlarged end portion and a shoulder portion extending outwardly with respect thereto and spaced inwardly from said outer portion, said shoulder portion being engagable within said cavity when said outer portion of said strap is inserted within the housing.

11. The shackle seal of claim 10 in which said cavity is of a non-circular configuration and said shoulder portion of said strap being of a compatible configuration with said cavity.

12. The shackle seal of claim 11 in which said strap includes side edges, a non-circular opening made between said side edges to reduce the strength of said strap adjacent said non-circular opening.

13. The shackle seal of claim 1 in which said plug means is formed of a material having a higher melting point than the first material.

14. In a shackle seal having a housing open at both ends and which is integrally formed with a strap having an outer end portion which is selectively inserted into one end of the housing and wherein plug means are used to close the other end of the housing the improvement comprising, a locking assembly selectively insertable within said housing, said locking assembly having a plurality of spring-like finger elements for selectively engaging said end portion of said strap when said strap is inserted within said one end of said housing, said locking assembly further including means for spacing said plug means for closing the other end of aid housing from said plurality of finger elements, and at least two supplemental leg means, said supplemental leg means and said means of spacing said plug means and said spring-like finger elements extending from a 15. In a shackle seal having a housing open at both ends and which is integrally formed with a strap having an outer end portion which is selectively inserted into one end of the housing and wherein plug means are used to close the other end of the housing the improvement comprising, a locking assembly selectively insertable within said housing, said locking assembly having a plurality of spring-like finger elements for selectively engaging said end portion of said strap when said strap is inserted within said one end of said housing, said locking assembly further including means for spacing said plug mean for closing the other end of said housing from said plurality of locking finger means, said housing being formed of a first material having a melting point and said locking assembly being formed of a second material having a melting point greater than the first material, and said plug means being formed of a material having a higher melting point than the first material.

16. In a shackle seal having a housing open at both ends which is integrally formed with a strap and wherein the strap includes an end portion which is selectively inserted into one end of the housing and wherein a plug means is used to close the opposite end of the housing and wherein the plug includes an end wall and an outer wall of a size to be frictionally received within the housing, and wherein the housing includes an inwardly extending ridge spaced from said other end of said housing and said plug has a groove adapted to receive the ridge with said groove being spaced from the end wall of the plug, and wherein the housing is formed of a material having a first melting point, the improvement comprising, a locking assembly which is selectively seated within said housing, said locking assembly including a base portion which is seated against an annular flange formed adjacent said one end of said housing, a plurality of locking means extending from said base portion and being slightly yieldable with respect thereto, said locking means being engagable with said end portion of said strap when said end portion of said strap is inserted within said one end of said housing, said locking assembly further including means for spacing said plug means relative to said locking means, and said locking assembly and the plug means being formed of a second material having a higher melting point than the material from which the housing is formed.

* * * * *